United States Patent [19]

Daughters

[11] 4,367,963

[45] Jan. 11, 1983

[54] REFILLABLE TYPEWRITER RIBBON CARTRIDGE

[75] Inventor: James R. Daughters, San Leandro, Calif.

[73] Assignee: Wordex, San Leandro, Calif.

[21] Appl. No.: 170,495

[22] Filed: Jul. 21, 1980

[51] Int. Cl.[3] ..... B41J 33/14

[52] U.S. Cl. ..... 400/208; 400/207; 400/694; 242/197; 242/199

[58] Field of Search ..... 400/194, 195, 196, 196.1, 400/207, 208, 208.1, 234; 242/197, 198, 199, 200; 229/15, 16, 16 A, 175; 242/55, 53

[56] References Cited

U.S. PATENT DOCUMENTS

| | | | |
|---|---|---|---|
| 1,927,667 | 9/1933 | Miller | 242/55 |
| 2,257,208 | 9/1941 | Wagner | 242/55 |
| 3,151,723 | 10/1964 | Wendt | 400/207 |
| 3,260,344 | 7/1966 | Doyle | 400/208 |
| 3,381,810 | 5/1968 | Lasher et al. | 400/207 X |
| 3,386,556 | 6/1968 | Dannatt et al. | 400/208.1 |
| 3,424,292 | 1/1969 | Goff, Jr. et al. | 400/208.1 |
| 3,481,445 | 12/1969 | Engle et al. | 400/208 |
| 3,627,118 | 12/1971 | Daggs | 242/55 |
| 3,710,915 | 1/1973 | Teichmann et al. | 400/234 X |
| 3,924,727 | 12/1975 | Morelli | 400/208.1 |
| 3,976,183 | 8/1976 | Fleischmann et al. | 400/208 |
| 3,977,511 | 8/1976 | Hengelhaupt | 400/207 X |
| 4,113,750 | 9/1978 | Isobe | 400/196 X |
| 4,184,594 | 1/1980 | Hehn | 242/199 X |
| 4,213,715 | 7/1980 | Haftmann et al. | 400/196.1 X |
| 4,240,757 | 12/1980 | Hanna | 400/196.1 |

FOREIGN PATENT DOCUMENTS

| | | | |
|---|---|---|---|
| 2317971 | 10/1974 | Fed. Rep. of Germany | 400/196 |
| 2346283 | 3/1975 | Fed. Rep. of Germany | 400/196.1 |
| 50-144518 | 11/1975 | Japan | 400/207 |
| 55-9808 | 1/1980 | Japan | 400/207 |

*Primary Examiner*—Ernest T. Wright, Jr.

*Attorney, Agent, or Firm*—Townsend and Townsend

[57] ABSTRACT

A protective carton-enclosed typewriter ribbon pancake assembly and associated cartridge frame having a biased-open top are disclosed. The pancake assembly includes a typewriter ribbon pancake spirally wrapped around a supply hub. The ribbon and supply hub are enclosed by a protective paper carton configured for insertion within the cartridge frame. The carton has holes through which the ends of the supply hub pass. The free end of the ribbon is attached to a take-up hub. A used ribbon pancake assembly is disposed of by merely releasing the biased top of the frame so that the used ribbon, protective carton and hubs free fall into an underlying waste receptacle. The carton is shaped to insure proper alignment of the pancake assembly within the cartridge.

21 Claims, 9 Drawing Figures

REFILLABLE TYPEWRITER RIBBON CARTRIDGE

BACKGROUND

Since their earliest introduction, typewriters have had ribbons which were replaced by the operator as needed. When the ribbon was worn out, the typewriter operator would remove the supply and takeup spools and the used ribbon wound about them from the typewriter. This was often a very dirty and messy task because the ribbon was laid bare to the operator. Because of this shortcoming, ribbon cartridges were developed for use on the typewriters. Ribbon cartridges were enclosed units having a supply hub, a ribbon pancake wound about the supply hub, and a takeup hub enclosed within a case. The operator was not likely to become dirty when changing the typewriter ribbon because it was almost totally enclosed within the case. Thus, changing the typewriter ribbon became a relatively neat and clean operation.

One drawback of the cartridges was that the entire cartridge, including the case, was thrown away once the ribbon was exhausted. This practice was economically acceptable so long as plastic materials from which the cases were made were cheap and the labor costs involved in producing the cartridges was low. However, with the rising cost of raw materials and the greatly increased costs for transportation and labor, these replaceable cartridges have become a relatively expensive aspect of modern office operations.

One way to reduce the costs involved is to replace the worn out ribbon within the cartridge with new, fresh ribbon. One way to do this is to ship the used cartridges back to a commercial facility where the sealed cases can be opened and the used ribbon replaced with new, fresh ribbon. This is presently being accomplished on a commercial scale. Another method to replace the ribbon is to have the operator replace the ribbon in the cartridge without the need for sending the entire cartridge back to a recharge facility. A cartridge designed for accomplishing this is disclosed in U.S. Pat. No. 3,260,344 to Doyle. This solution, however, merely reintroduces one of the original drawbacks of typewriter ribbons. The operator must contend with the messy, dirty, exposed typewriter ribbon within the case much in the same manner as the operator was exposed to the dirty typewriter ribbon in the typewriter.

One limitation of operator recharged cartridges is that cartridges of the type which have gears used to advance the ribbon are not suitable for operator replacement. This is because the gears generally get dirty during use and must be cleaned between each recharging for optimal performance. Further, gears and other moving parts may require selective replacement. These tasks are best provided by a recharge facility and are not truly suitable for performance by the operator. However, cartridges of the type which incorporate no gears or other moving parts, except for the rotating hubs and the moving ribbon, such as the ribbons used in IBM "Selectric" typewriters, are quite suitable candidates for operator replaceable ribbons. However, heretofore rechargeable cartridges have been unacceptable for operator replacement of the ribbon because of the lack of means for shielding the operator from the dirty ribbon.

SUMMARY OF THE INVENTION

The present invention solves the above problems of the prior art by providing a ribbon pancake assembly in which the ribbon is enclosed within a protective cardboard carton. This allows the operator to easily and conveniently replace a used ribbon within a ribbon cartridge frame by a new, fresh ribbon with little effort and a minimal chance of getting dirty in the process. Also disclosed is a cartridge frame adapted to accept the ribbon pancake assembly and enhance its usefulness while being compatible with a variety of currently used typewriters.

The ribbon pancake assembly includes a supply hub about which is wound a spirally wrapped ribbon. The disk-shaped ribbon pancake is enclosed within the protective carton. The carton is preferably made from stiff paper. The carton has a lower surface and an upper surface which lie adjacent the parallel sides of the ribbon pancake. The upper and lower surfaces of the pancake are connected by a number of side members to enclose the ribbon pancake within the carton. The upper and lower surfaces of the carton have coaxial holes for registry with the ends of the supply hub. The ribbon pancake is therefore secured within the protective carton by the registry of the supply hub within the holes and by the side members of the carton. There is at least one opening in the carton adjacent the circumferential portion of the ribbon pancake so that the outer, free end of the ribbon can pass outside of the carton. The free end is attached to a take-up hub. The take-up hub is typically removably fastened to one of the side members to allow the operator to easily thread a newly loaded ribbon within a cartridge frame.

By enclosing the ribbon pancake within a protective paper carton, anyone who handles the ribbon pancake assembly will not be dirtied by contact with the ribbon. A clean leader is attached to the outer, free end of the ribbon to further protect the operator from exposure to the ribbon during loading. Having the take-up hub attached directly to the outer end of the ribbon eliminates any need for the user to try to thread the end of the ribbon onto a hub or spool. These advantages engender operator acceptance and speed ribbon replacement.

Enclosing the ribbon pancake within the carton also reduces the tendency of the spirally-wrapped ribbon to telescope or pancake during shipping and while mounted in the cartridge frame. Therefore, special supporting ribs in the frame need not be provided to resist pancaking.

Also disclosed is a cartridge frame specifically adapted to accept the novel ribbon pancake assembly and to be compatible with a number of typewriters currently in use. The cartridge frame includes a bottom, sides, and a top. The top and bottom are attached by a hinge along one side and are snap locked together to enclose the ribbon pancake assembly within the frame. The bottom and top have coaxial holes for supporting the supply and take-up hubs of the pancake assembly. Openings within the sides allow the ribbon to be threaded through the side of the frame as it passes between the supply hub and the take-up hub. The cartridge frame thus provides support for the take-up and supply hubs as well as defining a path between the take-up and supply hubs for the passage of the ribbon.

The provision of the frame allows the ribbon pancake assembly to be easily and quickly removed from and placed within the typewriter. The frame is configured to allow its use with a number of commercially available typewriters.

The hinged bottom and top of the frame are biased into a normally open configuration. This allows the user to dispose of used ribbons without coming into physical contact with them. The user, by merely depressing the snap-lock openers, causes the top of the cartridge frame to spring open thus allowing the used ribbon pancake assembly to fall freely into an underlying waste receptacle. This self-springing feature is economically realized by molding the entire cartridge frame as a single piece from self-springing plastic so that the hinge or hinges form an integral part of the frame and possess an inherent bias. Thus the frame can be made at a lower cost while fully employing the novel biasing feature of the invention.

The lower surface of the ribbon pancake assembly is shaped to generally conform to the lower inside surface of the cartridge frame. This provision provides two significant advantages. The first is the operator is assisted in proper placement of the pancake assembly within the frame by the congruent shapes of the lower surface of the paper carton and the bottom of the cartridge frame. The pancake assembly can therefore be placed within the frame in only one manner thus reducing operator error. Also, the provision of the extended lower surface helps to ensure the proper discharge of the used ribbon pancake assembly from the cartridge frame. The lower surface acts to cleanly sweep away the used ribbon so that the discharge is complete and trouble-free.

The cartridge frame and ribbon pancake assembly allow the replacement of only the ribbon pancake assembly rather than the entire ribbon cartridge. Therefore, the cost of replacing the ribbon is lowered at the expense of very little increase in operator time to perform the ribbon change. Since only the ribbon pancake assembly must be shipped, shipping costs are also reduced because of the decrease in weight and size for the same number of ribbons. Thus, typewriter ribbon replacement is achieved at a greatly reduced cost with high operator acceptance.

Other features and advantages will be apparent from the following description in which the preferred embodiment has been set forth in detail in conjunction with the accompanying drawing.

BRIEF DESCRIPTION OF THE DRAWING

FIG. 5A is an illustration of the cartridge of this invention after it has been conventionally removed from a typewriter and shown being grasped to actuate the release mechanism.

FIG. 5B is an illustration of the frame of this invention wherein the frame has been opened, inverted and specifically illustrating the dumping of the used ribbon pancake assembly into a waste receptacle.

FIG. 5C is a view of the emptied frame laid on a flat surface with the carton-enclosed ribbon pancake assembly being placed thereon immediately before threading of the ribbon through the frame.

FIG. 5D is a view similar to FIG. 5C therein illustrating threading of the tape throughout the frame.

FIG. 5E illustrates the frame of FIG. 5D immediately before closing.

DETAILED DESCRIPTION OF THE PREFERRED EMBODIMENT

Turning now to the figures, the typewriter ribbon cartridge 2 of the present invention broadly includes a ribbon pancake assembly 4 and a cartridge frame 6. The ribbon pancake assembly 4 will be described in detail first and then the cartridge frame 6 will be discussed. Finally the procedure for using the ribbon cartridge 2 will be described.

Figure 2:
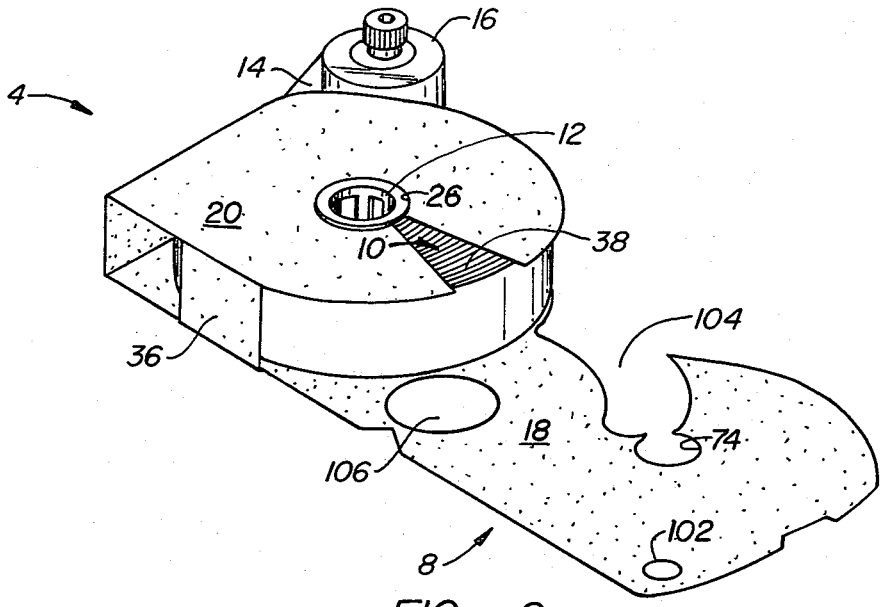
FIG. 2 is a perspective view of the carton-enclosed ribbon pancake assembly with take-up hub attached.
Figure 3:
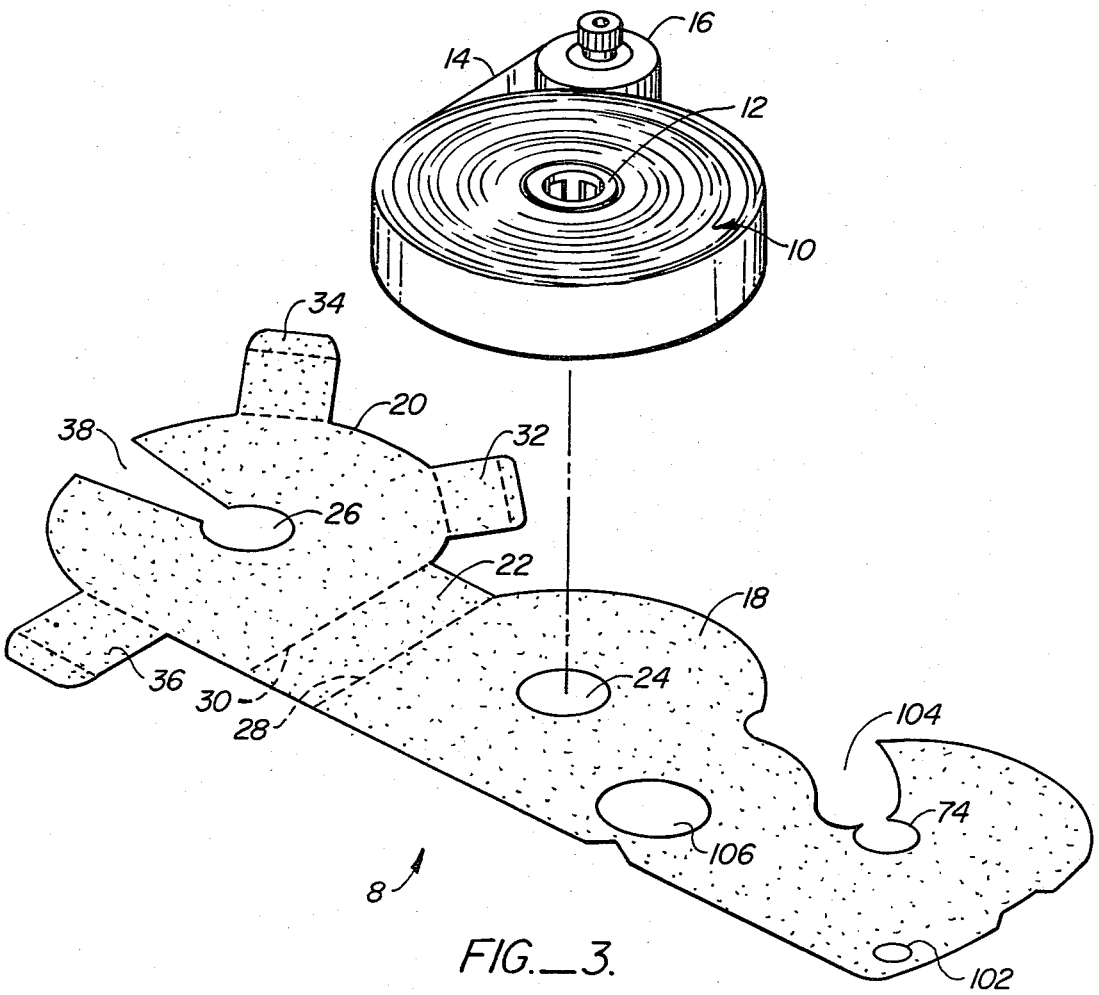
FIG. 3 is an exploded view of the ribbon pancake of this invention shown with the carton in an open position ready for folding about the ribbon pancake.

Turning now to FIGS. 2 and 3, the ribbon pancake assembly 4 will be described. The pancake assembly 4 includes a protective carton 8 which encloses a ribbon pancake 10 spirally wrapped around a supply hub 12. Carton 8 can be made from stiff paper or other suitable materials. At the outer end of the ribbon pancake 10 is a leader 14 attached to a take-up hub 16.

The paper carton 8 includes a lower surface 18 and an upper surface 20 joined by a connecting portion 22. The lower and upper surfaces 18, 20 have apertures 24, 26 for receipt of the outer ends of the supply hub 12 when the carton 8 is folded along fold lines 28, 30 to capture the ribbon pancake 10 therein. A number of flaps 32, 34, 36 are provided to extend between the upper and lower surfaces 20, 18 and are typically glued to the lower surface 18 at the outer ends of the flaps 32, 34 and 36. The upper surface 20 of the carton 8 has a view slot 38 located for alignment with a slot 82 in the frame 6 so that the unused ribbon pancake 10 in the cartridge 2 can be determined. The lower surface 18 is configured to overlie the adjacent surface 42 of the frame 6 as more fully discussed below.

Prior to use, the take-up hub 16 is attached to flap 32, typically with a piece of tape which for the sake of clarity is not shown. Since the leader 14 is prefastened to the take-up hub 16, the operator never has to bother with threading the end of a ribbon onto a hub or spool. Other modes of attachment, such as fastening the outer layer of leader 14 to to the second layer of leader 14, can also be used.

Figure 1:
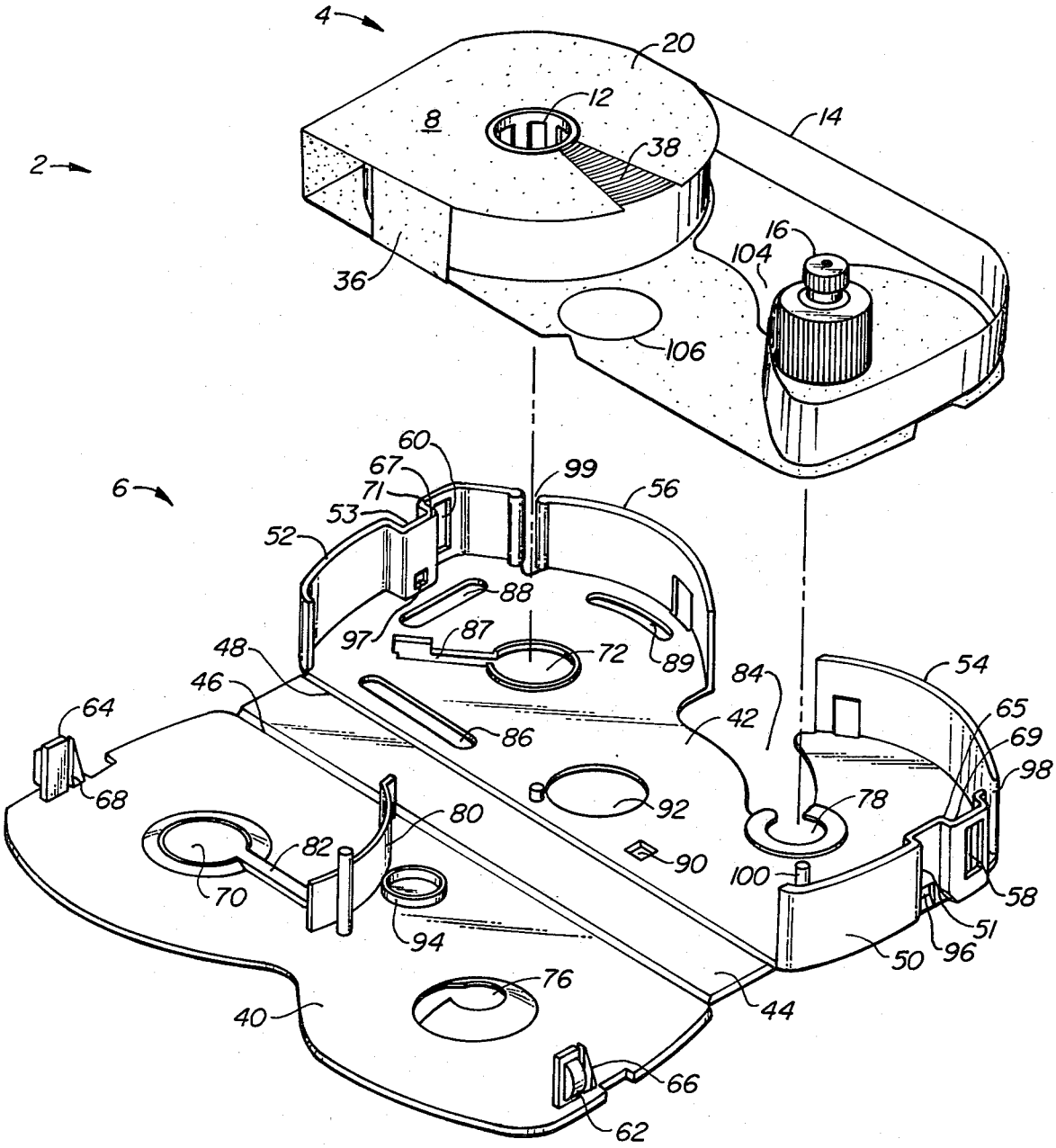
FIG. 1 is an exploded view of the carton-enclosed ribbon pancake assembly, cartridge frame and take-up hub, with the carton-enclosed ribbon pancake, threaded ribbon and take-up hub shown in an exploded relation above the frame.
Figure 4:
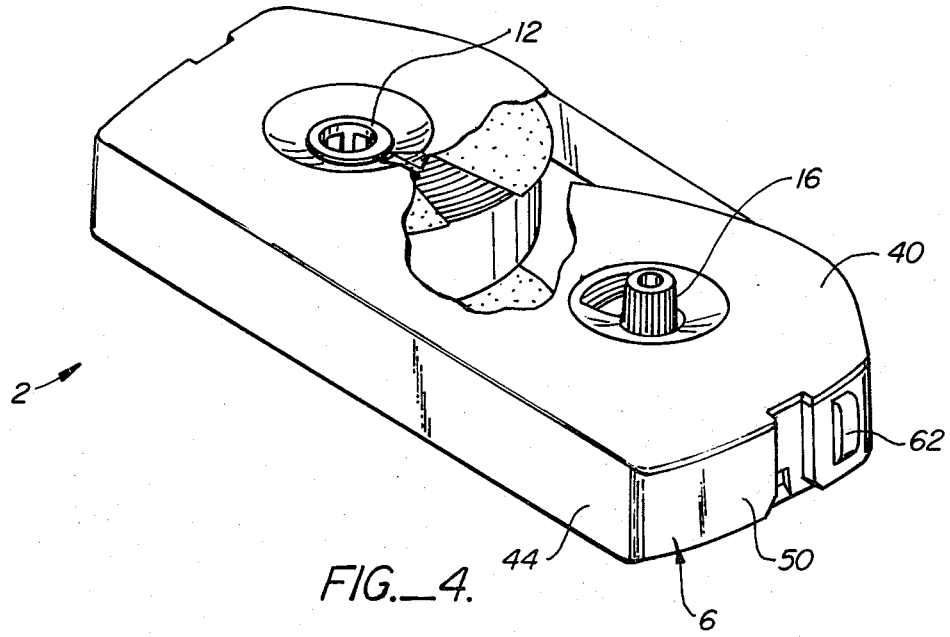
FIG. 4 is an assembled view of the cartridge with the ribbon within the frame and with portions of the frame broken away for clarity of understanding.

The cartridge frame 6 is configured to be compatible with various typewriters (not shown or claimed) as well as to enhance the ease of use of the carton 8 enclosed ribbon pancake assembly 4. Turning to FIG. 1, the cartridge frame 6 includes a top 40 and a bottom 42. The top and bottom 40, 42 are joined by a hinged side 44. The hinged side 44 is connected to the top 40 along hinge 46 and to the bottom 42 along hinge 48. Side walls 50, 52 and face walls 54, 56 extend normally from respective portions of the periphery of bottom 42. Side walls 50, 52 each have a rectangular aperture 58, 60 for engagement with snap lock fasteners 62, 64 located on the top 40. A pair of angularly inclined guide blocks 66, 68 are mounted adjacent to the snap lock fasteners 62, 64 so that as top 40 is registered above bottom 42, the snap lock fasteners 62, 64 are guided into position for engagement within apertures 58, 60 by sliding along edges 65, 67. For precise positioning, and full registry of fasteners 62, 64 within apertures 58, 60, corners 69, 71 are sharp corners. The closed configuration is shown in FIG. 4.

In FIG. 1 the pancake assembly 4 is shown in exploded relation over an open cartridge frame 6. It should be noted that the ends of the supply hub 12 extend through correspondingly positioned apertures 24, 26 in the carton 8 so that the ends of the supply hub 12 may be registered with correspondingly located holes 70, 72 in the top 40 and bottom 42 of the frame 6. Holes 76, 78 are formed in the top 40 and bottom 42 of the frame 6 for receipt of the ends of take-up hub 16. The lower surface of the carton 8 has a hole 74, shown in FIG. 3, which overlies hole 78 in the bottom 42 of the frame 6. This allows the proper registry of the ends of the take-up hub 16 to holes 76, 78 when the frame 6 is in the closed, assembled configuration shown in FIG. 4.

A number of other features of the frame 6 will now be described. An arcuate divider 80 extends from the interior surface of the top 40 of the frame 6 and serves two basic functions. It keeps the ribbon pancake 10 on the supply hub 12 from unwinding within the frame 6 to prevent interference by any loose ribbon with the proper operation of the cartridge 2. Divider 80 also acts to separate the top 40 and the bottom 42 of the frame 6 so that the ribbon pancake 10 does not become pinched within the cartridge 2.

A cartridge view slot 82 is formed within the top 40 and extends from hole 70 radially outwardly towards divider 80. The alignment of view slots 82 and 38 allow the typewriter operator to determine the amount of unused ribbon on the supply hub 12.

A cut-out 84 is formed in the bottom 42 of the frame 6 between hole 78 and the periphery of the bottom 42. This cut-out 84 allows an advancing mechanism (not shown or claimed) on a typewriter to engage the take-up hub 16 to advance the ribbon from pancake 10. A number of additional cut-outs 86–90 in the bottom 42 of the frame 6 are provided so that the cartridge 2 is compatible for use with various typewriters.

A circular hole 92 is formed within the bottom 42 of the frame 6 near the central portion of hinge edge 48. This hole 92 allows access to a similarly situated post 94 formed on top 40 of the frame 6. Certain typewriters, for example IBM "Selectric" typewriters, can be used with either single strike or multi-strike ribbons. If a multi-strike ribbon is used, post 94 is made higher than that shown in FIG. 1 so that a sensing mechanism (not shown or claimed) within the typewriter is activated to regulate the speed of the ribbon advance from pancake 10.

Side walls 50, 52 have an inwardly extending portion 51, 53, respectively. Gripping holes 96, 97 are formed within portions 51, 53 adjacent bottom 42 and allow correspondingly located grippers (not shown or claimed) on the typewriter to securely hold the cartridge 2 within the typewriter.

A supply slot 99 is formed between the opposed edges of side wall 52 and face wall 56. The edges of the side and face walls 52, 56 are rounded so that the ribbon may pass freely through the slot 99. A similar take-up slot 98 is provided between side wall 50 and face wall 54 for the reentry of the ribbon into the frame 6. The ribbon path thus proceeds from the spirally wound ribbon pancake 10, through an opening in the paper carton 8 adjacent flap 32, through supply slot 99, past face walls 56 and 54, through take-up slot 98, around a guide post 100 extending from the bottom 42 of the frame 6, and to the take-up hub 16. This path is shown in FIGS. 1, 4 and 5D.

In the preferred embodiment the frame 6 is a single, unitary item with integral hinges 46, 48 and made from a material such as an appropriate ABS resin. If desired, the frame 6 could be produced from more than a single element, however, not without a probable increase in cost. Also, the self-springing hinges 46, 48 have been emphasized as a desirable characteristic for realizing the ultimate advantages resulting from the novel ribbon pancake assembly 4.

To keep the proper tension on a ribbon, typewriters typically engage one end of the supply hub 12 and apply a drag to the supply hub 12. However, if desired the drag could be supplied by appropriate means within the frame 6 or by the protective carton 8. In such a case, the end of the supply hub 12 would not need to be accessible by the machine so that frame 6 would not need holes 70, 72.

Figure 5A:
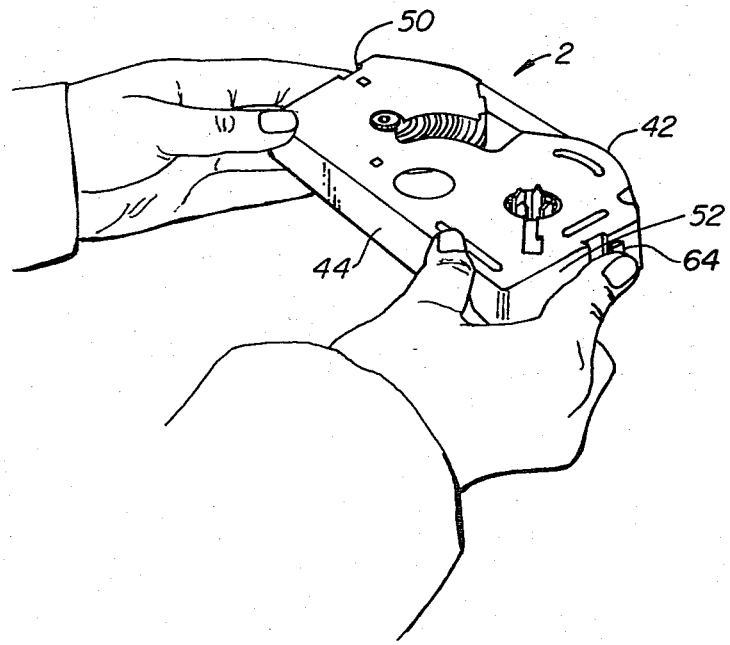
FIGS. 5A–5E are a cartoon series illustrating the use of the carton-enclosed ribbon pancake and frame of this invention.
Figure 5B:
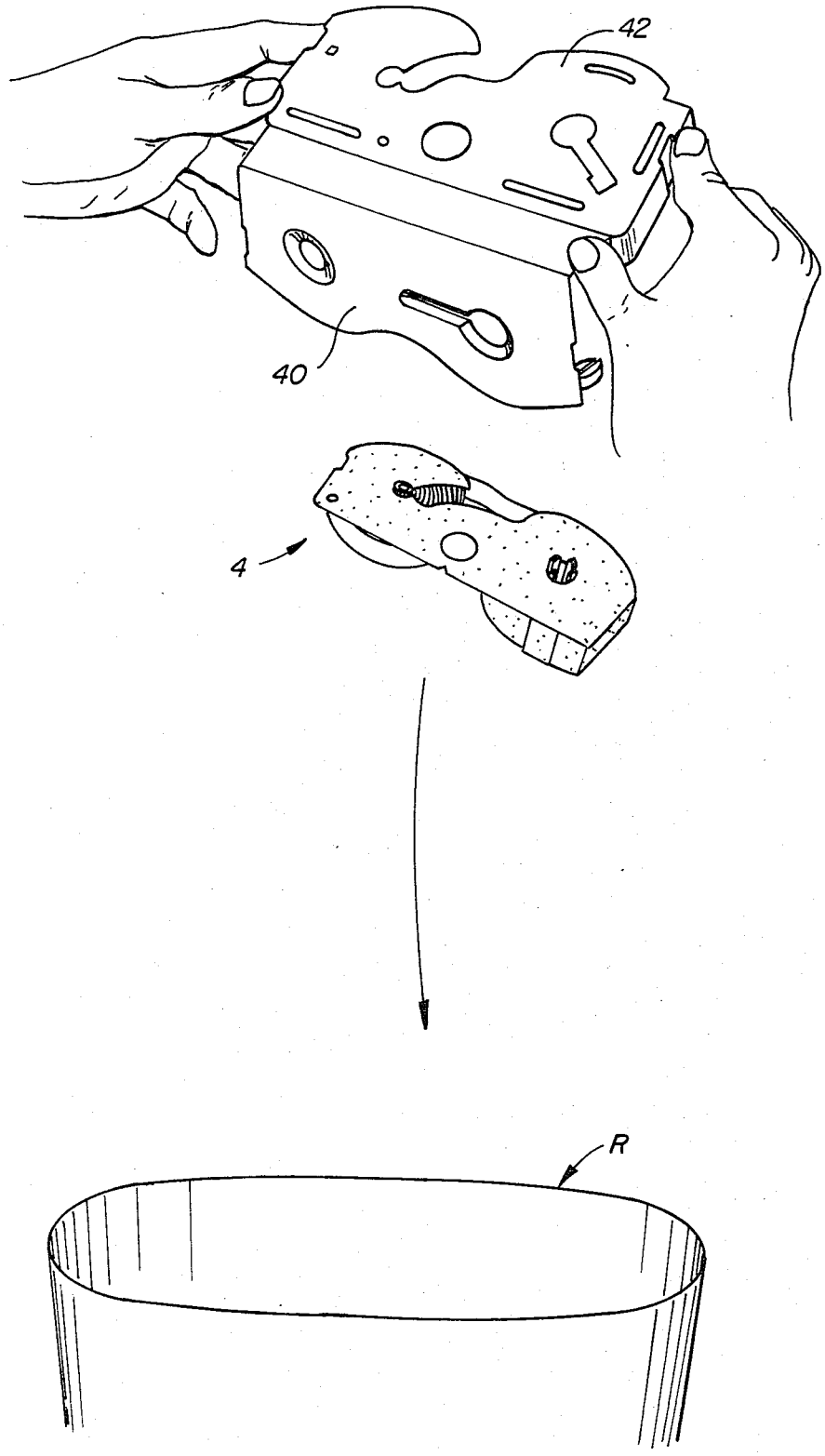
Figure 5C:
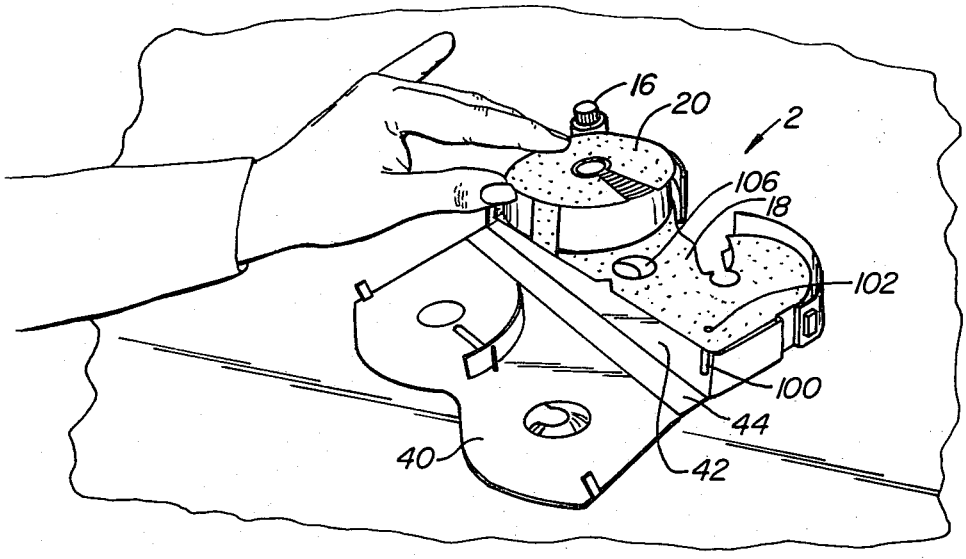
Figure 5D:
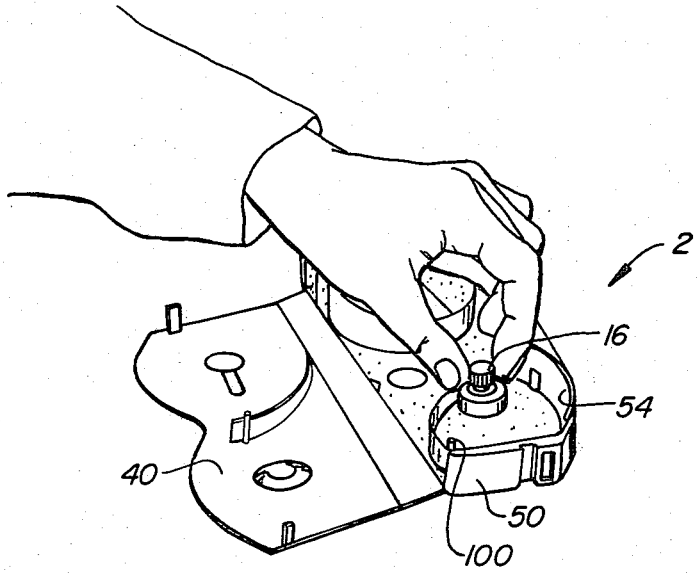
Figure 5E:
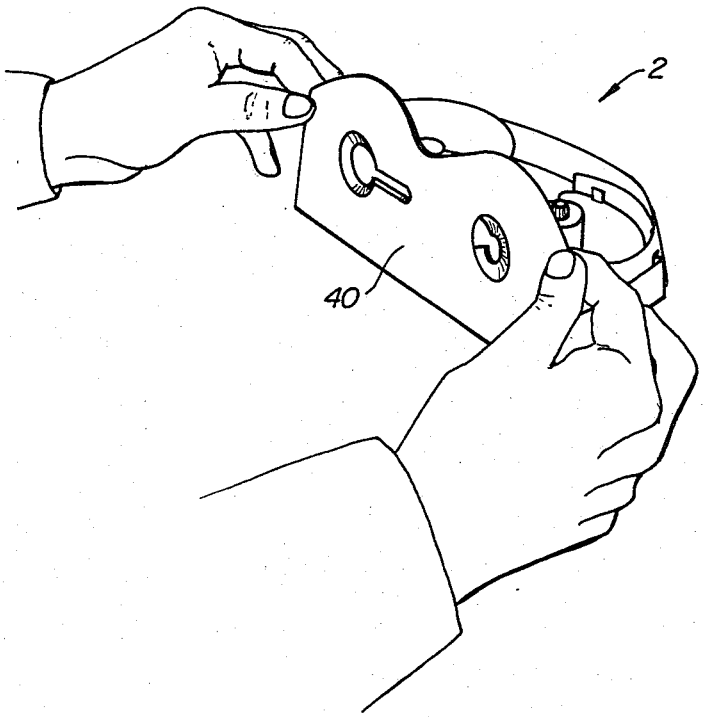

Turning now to FIGS. 5A–5E, the use of the replaceable ribbon pancake assembly 4 in conjunction with the self-springing frame 6 will be described. FIG. 5A shows an operator holding a cartridge 2 with a used typewriter ribbon. The operator typically grasps the cartridge 2 by side walls 50, 52 and hinged side 44 with the bottom 42 of the cartridge 2 facing up. By pressing on the ends of snap lock fasteners 62, 64 extending through apertures 58, 60 with one's index fingers, the biased top 40 springs downwardly open allowing the used ribbon pancake assembly 4 in FIG. 5B to freefall from the cartridge 2 into an underlying waste receptacle R. The operator need not touch the used ribbon at all. FIG. 5C shows the operator placing a new ribbon pancake assembly 4 within the bottom 42 of the frame 6 as the frame 6 is resting on a flat surface. The congruent shape of the lower surface 18 of paper carton 8 and the bottom 42 of the frame 6 allows easy visual determination of the proper placement of the pancake assembly 4 within the frame 6. The take-up hub 16 is attached to the outside of the paper carton 8 so that the leader 14 passes through supply slot 99. This feature also insures proper loading of the pancake assembly 4 into the frame 6. The lower surface 18 of the paper carton 8 includes a guide post hole 102 which loosely fits around guide post 100. Lower surface 18 has cut-outs 104, 106 conforming to cut-out 84 and hole 92, respectively.

The user now grasps take-up hub 16 as in FIG. 5D and threads the leader 14 attached to take-up hub 16 past face walls 56, 54, through take-up slots 98, around guide post 100 to where one end of the take-up hub 16 is registered to holes 74 and 78. This path is also shown in the exploded view of FIG. 1. Because the take-up hub 16 is attached to an initial length of leader 14, the user is not exposed to dirty ribbon during this threading process. The user then folds the top 40 of the frame 6 over the bottom 42 and locks them together through the engagement of snap lock fasteners 62, 64 within apertures 58, 60. This also locks hubs 12, 16 within their respective holes 70, 72 and 76, 78 in the top 40 and bottom 42 of the frame 6. The cartridge 2 is now reinserted into the typewriter in the normal manner.

Certain modification and variation may be made to the invention without departing from what is the subject of the invention. For example, the frame 6 need not be a generally solid structure as shown in the figures, but may be more of a lattice-work structure if so desired. Further, since it is desired that the ribbon pancake 10 rotate smoothly within the paper carton 8, a graphite slip sheet may be placed between the ribbon pancake 10 and the paper carton 8 for lubricity.

I claim:

1. A protective carton for enclosing a typewriter ribbon spirally wound in a pancake about a supply hub, said carton and pancake being configured to be enclosed within a rechargeable typewriter ribbon cartridge adapted to admit said carton, said cartridge having a frame, a top surface and a bottom surface, said carton comprising:

a first section defining a lower surface, said lower surface to rest adjacent the bottom surface of said cartridge;

a second section defining an upper surface;

a third section including means for connecting said lower and upper surfaces to define a space for enclosing said ribbon pancake therein;

said third section defining at least one opening for passage of said ribbon from said ribbon pancake out of and back into said carton; and said upper and lower surfaces having apertures for registry about the ends of said supply hub so that said spirally wound ribbon may rotate within said space as said ribbon is taken from said ribbon pancake through said opening, whereby an ink ribbon may be replaced in the cartridge.

2. The carton of claim 1 wherein said lower surface includes means for aligning said carton within said frame.

3. The carton of claim 2 wherein said means for aligning is generally congruent with said bottom surface of the cartridge.

4. The carton of claim 1 wherein said carton is paper.

5. A typewriter ribbon pancake assembly for enclosure within a reloadable cartridge frame, said pancake assembly comprising:

a supply hub;

a disk-shaped ribbon pancake having generally flat top and bottom surfaces and a circular side edge, said ribbon pancake being a ribbon spirally wrapped about said supply hub, and having an outer, free end; and a protective carton immediately enclosing and in direct supporting contact with said spirally wrapped ribbon pancake, said carton comprising an upper surface and a lower surface and at least one side member joining said upper and lower surfaces to enclose said ribbon pancake, said side member including at least one opening for passage of the free end therethrough, said upper and lower surfaces having apertures through which the ends of said supply hub pass.

6. The pancake assembly of claim 5 further comprising a take-up hub attached to said free end external of said carton.

7. The pancake assembly of claim 5 further comprising means for aligning said pancake assembly within said frame.

8. The pancake assembly of claim 5 wherein said lower surface is generally congruent with a surface of said cartridge frame to promote proper placement of said pancake assembly within said frame.

9. A reloadable typewriter ribbon cartridge comprising:

a typewriter ribbon pancake assembly including a disk-shaped spirally wound ribbon pancake having generally flat top and bottom surfaces and a circular side edge, said ribbon pancake having an outer, free end, and a protective carton immediately enclosing said supporting said ribbon pancake, said carton comprising an upper surface and a lower surface and at least one side member joining said upper and lower surfaces to enclose said ribbon pancake with said upper surface adjacent said top surface and said lower surface adjacent said bottom surface, said side member including an opening for passage of the free end therethrough; and a cartridge frame including a top, a bottom, means for hingedly connecting said top and bottom, means for securing said top in spaced relation over said bottom to capture said ribbon pancake assembly therebetween, a supply opening adjacent said captured ribbon pancake and configured for passage therethrough of ribbon from said ribbon pancake, and a take-up opening for passage of ribbon from said supply opening for gathering said ribbon within said frame.

10. The cartridge of claim 9 wherein said pancake assembly includes a supply hub around which said ribbon pancake is wound.

11. The cartridge of claim 10 wherein said pancake assembly includes a take-up hub attached to said free end of said ribbon pancake.

12. The cartridge of claim 10 wherein said carton includes coaxial apertures in said upper and lower surfaces for registry of the ends of said supply hub.

13. The cartridge of claim 11 wherein said frame has means for rotatably positioning said supply hub and said take-up hub within said frame.

14. The cartridge of claim 13 wherein said means for positioning includes a first pair of coaxial holes in said frame for engagement with the ends of said take-up hub.

15. The cartridge of claim 14 wherein said means for positioning includes a second pair of coaxial holes in said frame for engagement with the ends of said supply hub.

16. The cartridge of claim 9 wherein said protective carton is paper and said cartridge frame is a unitary piece.

17. The cartridge of claim 9 wherein said means for hingedly connecting includes means for biasing said top away from said bottom.

18. The cartridge of claim 11 wherein said take-up hub is removably secured to said pancake assembly.

19. The cartridge of claim 9 wherein said lower surface of said carton is generally congruent with at least a portion of the bottom of said frame for proper positioning of said pancake assembly within said frame.

20. A method for replacing a typewriter ribbon in a reloadable cartridge frame which has been used in a typewriter, said cartridge frame having a top, a bottom, a hinge therebetween, and fastening means for securing the top to the bottom, said hinge biased to force said top away from said bottom, comprising the following steps:

removing the frame with used ribbon therein from the typewriter;

releasing said fastening means, allowing said hinge to to rotate said top away from said bottom thus exposing the used ribbon;

emptying the used ribbon from said frame;

placing in the cartridge frame a fresh ribbon wound on a supply hub and enclosed in a protective carton having apertures through which the ends of said supply hub protrude and an opening through which an outer, free end of the fresh ribbon passes;

threading the ribbon from the opening in said carton through the frame;

closing said top onto said bottom to enclose said carton and ribbon contained therein, and securing said top to said bottom.

21. The method according to claim 20 wherein said fresh ribbon has a take-up hub attached to said outer, free end of the ribbon.

* * * * *